United States Patent [19]

Staehlin

[11] Patent Number: 4,538,154

[45] Date of Patent: Aug. 27, 1985

[54] ANTENNA STOW MECHANISM

[75] Inventor: John H. Staehlin, Lutherville, Md.

[73] Assignee: Westinghouse Electric Corp., Pittsburgh, Pa.

[21] Appl. No.: 544,167

[22] Filed: Oct. 21, 1983

[51] Int. Cl.[3] ..... H01Q 1/28

[52] U.S. Cl. ..... 343/705; 343/765

[58] Field of Search ..... 343/705, 708, 711, 712, 343/713, 763, 765, 809

[56] References Cited

U.S. PATENT DOCUMENTS 3,656,164 4/1972 Rempt ..... 343/705

3,766,561 10/1973 Johnson ..... 343/705

FOREIGN PATENT DOCUMENTS 1257435 12/1971 United Kingdom ..... 343/763

*Primary Examiner*—Eli Lieberman

*Attorney, Agent, or Firm*—William E. Zitelli

[57] ABSTRACT

Certain present antenna assemblies require that their antenna structure be first rotated to a predetermined azimuth orientation prior to being retracted translationally along an axis to a stowed state so that it may conform to the surface of the antenna supporting structure which it is designed to rest against. An antenna assembly which requires no such prior maneuvering of the antenna structure before retraction thereof is disclosed. Retraction of the antenna structure in accordance with the present invention may occur at any random azimuth orientation of the antenna structure. In one embodiment, at least one cam follower bearing is fixedly coupled to a support housing of the antenna assembly and positioned to engage one of a plurality of integral cam grooves disposed on the surface of a shaft which supports the antenna structure and used to extend and retract the antenna structure with respect to the support housing surface. During the translational retraction movement of the antenna structure, the cam follower bearing guides the drive shaft and associated antenna structure rotationally along the engaged cam groove which terminates at a common angular position of the drive shaft which corresponds to the predetermined azimuth orientation of the antenna structure. In this manner, the antenna structure is rotated in azimuth to the predetermined angular orientation automatically as it is being retracted from its deployed state to its stowed state against the surface of the support housing.

8 Claims, 5 Drawing Figures

ANTENNA STOW MECHANISM

BACKGROUND OF THE INVENTION

The present invention is related to radar antennas in general, and more particularly, to an antenna assembly which is operative to rotate an antenna structure in azimuth to a predetermined angular orientation automatically as it is being retracted from its deployed state to its stowed state against the surface of the supporting structure thereof.

Some radar antennas, especially those of the type for application on-board aircraft, such as helicopters and the like, are generally mounted on a supporting structure, like the fuselage, for example, and are deployed away from the surface thereof during operation so that they may be rotated to scan in azimuth without contacting physically any protrusions from the surface of the supporting structure in the antenna's rotational path. In addition, prior to retraction to a stowed state, antennas of this type may be required to be rotated to a predetermined azimuth angle so that when retracted, the antenna structure is of an orientation to fit the contour of the surface portion of their supporting structure, which it is designed to rest against in the stowed state.

FIGS. 1 and 2 are cross-sectional illustrative views of an antenna assembly which is required to be maneuvered for retraction so that an antenna pod structure 10 thereof is properly oriented in azimuth against the fuselage of the aircraft in the stowed state. FIG. 1 illustrates the antenna assembly having its antenna structure 10 extended away from the external surface 12 of the aircraft in a deployed state. Structural members 14 constitute that portion of the aircraft which supports the overall antenna assembly. In the particular embodiment of FIGS. 1 and 2, the antenna structure 10 is coupled to a main drive shaft 16 utilizing a conventional coupling clamp 18. The main drive shaft 16 is disposed through a main drive housing 20 for alignment thereof during the extension and retraction translational movement. The translational movement through the main drive housing 20 is assisted by a recirculating ball spline 22 and associated ball spline grooves at 24. The main drive shaft 16 is guided along its translational axis for extension and retraction by a linear ball screw 26 and associated ball nuts 28 and thrust plate assembly 30. A flange 32 provides additional guidance along a predetermined cam follower guide path 34. A conventional rotary joint assembly 36 is provided in the top portion of the main drive shaft 16 and driven when engaged in the deployed state as shown in FIG. 1 by a conventional hydraulic drive mechanism 40. The hydraulic drive mechanism 40 may further be utilized for driving the antenna assembly between its deployed and stowed states (refer to FIGS. 1 and 2, respectively).

A waveguide flange 42 is disposed in a region on top of the drive shaft 16 to mate with a waveguide flange input 44 when the antenna assembly is in the deployed state as shown in FIG. 1.

In operation then, the antenna pod structure 10 is extended with a translational movement along the axis indicated by the double arrow 50 from its stowed state of FIG. 2 to its deployed state of FIG. 1 using the conventional guide assist mechanisms described hereabove. When in the deployed state, the rotary joint assembly 36 is engaged to the hydraulic drive assembly 40 to provide azimuth rotation of the antenna pod structure 10 angularly about the longitudinal axis 50 of the main drive shaft 16. Moreover, when in the deployed state, the waveguide input connection is mated at 42/44 to permit radar transmission and reception operation.

Now, prior to being retracted, the antenna pod structure 10 may be in a random azimuth angular orientation with respect to the supporting structure surface 12. Thus for retraction, the procedure requires that the antenna pod structure 10 be rotated, utilizing the hydraulic drive assembly 40 and rotary joint assembly 36, to a predetermined azimuth position such that when retracted along path 50 the antenna pod 10 may be properly oriented in azimuth against the fuselage or surface 12 of the aircraft in its stowed state. The primary problem with this maneuver of course is that each time the antenna pod structure 10 is to be retracted, it must be remembered to first rotate it to the proper azimuth orientation and then retract it along the translational path 50 to its stowed state. If this initial rotational maneuver is not conducted prior to retraction, the antenna pod structure 10 will not be positioned properly against the aircraft surface 12 in the stowed state which may cause deleterious effects to either the pod structure 10, the surface 12 or both. Thus, to alleviate having to remember to rotate the pod structure 10 prior to each retraction thereof, it would be desirable to have this entire procedure occur automatically during the retraction operation.

SUMMARY OF THE INVENTION

In accordance with the present invention, the aforementioned antenna assembly includes a drive shaft having mechanically coupled to one end thereof the antenna structure and translationally movable along a first axis to permit extension and retraction of the antenna structure with respect to the stationary housing surface. The drive shaft has a plurality of integral cam grooves disposed along the periphery at the other end thereof and extending longitudinally along the surface to the one end. At least one cam follower bearing is fixedly coupled to the stationary housing and disposed in a position to engage randomly one of the cam grooves of the plurality along the periphery at the other end of the drive shaft at the commencement of retraction of the antenna structure. The cam follower bearing guides the drive shaft rotationally along the path of the engaged cam groove during the translational retraction movement of the antenna structure. The antenna structure is driven to the predetermined azimuth orientation by the cam guided drive shaft rotation during retraction thereof. The cam follower bearing is further positioned on the stationary housing to clear the longitudinal tips of the cam grooves along the periphery of the other end of the drive shaft when the antenna structure is in the deployed state. Thus, the antenna structure may be rotatably driven by the drive shaft in the deployed state without the cam follower bearing engaging any of the cam grooves of the drive shaft.

More specifically, the integral cam grooves of the drive shaft may extend from various positions around the periphery at the other end of the drive shaft to a common position on the periphery of the one end to permit the drive shaft to be rotatably guided to substantially a common angular orientation by the cam follower bearing during the translational retraction movement thereof independent of which cam groove is engaged by the cam follower bearing at the commencement of retraction. The common cam groove position on the periphery at the one end of the drive shaft corresponds to the predetermined azimuth orientation of the antenna structure.

In one embodiment, the drive shaft includes two sets of integral cam grooves, each set covering a mutually exclusive portion of the periphery at the other end of the drive shaft, preferably 180°, and extending longitudinally therefrom along the surface of the drive shaft to a corresponding common position on the periphery at the one end of the drive shaft. Preferably, the common cam groove positions for this embodiment are disposed substantially 180° apart from each other.

DESCRIPTION OF THE PREFERRED EMBODIMENT

Figure 3:
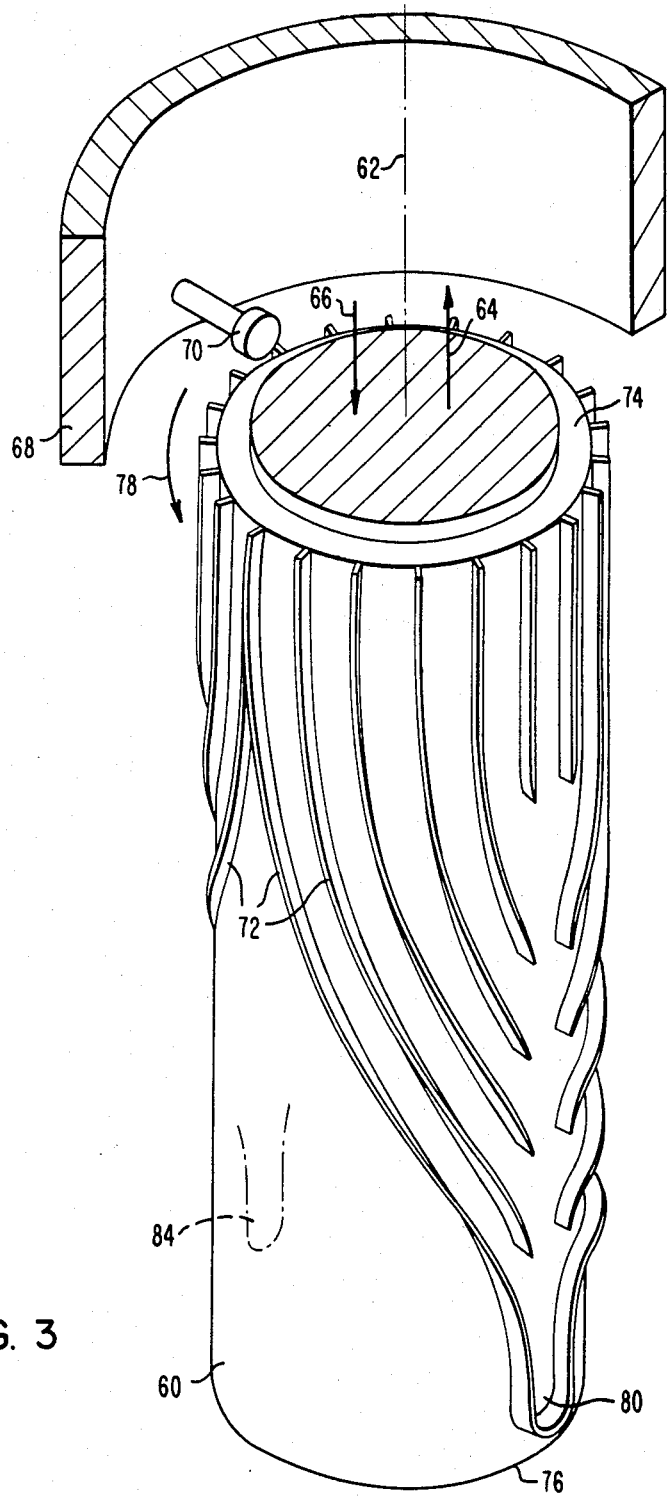
FIG. 3 is an illustrative sketch of a mechanism which embodies the principles of the present invention.

The principles of the present invention may be described in connection with the illustrative sketch of FIG. 3 which depicts a drive shaft 60 translationally movable along an axis 62 in either a retraction direction, denoted by the arrow 64, or a deployment direction, denoted by the arrow 66. The drive shaft 60 moves translationally with respect to a stationary housing, a portion of which being depicted at 68. The housing 68 includes at least one cam follower bearing 70 fixedly coupled thereto. The drive shaft has a plurality of integral cam grooves 72 disposed around the periphery at one end 74 thereof. The grooves 72 extend longitudinally along the surface of the drive shaft 60 to the other end 76 thereof. The cam follower bearing 70 is positioned on the stationary housing 68 to engage randomly one of the cam grooves 72 of the plurality along the periphery at the end 74 of the drive shaft 60 at the commencement of the retraction motion 64. During the translational retraction motion 64, the bearing 70 guides the drive shaft 60 rotationally along the path of the engaged cam groove. The rotational motion is about the axis 62 and is denoted by the arrow 78.

Generally, the integral cam grooves 72 of the drive shaft 60 may extend longitudinally along the surface thereof from various positions around the periphery at the one end 74 of the drive shaft 60 to a common position, like that shown at 80, for example, on the periphery at the other end 76 thereof. This permits the drive shaft 60 to be rotatably guided to substantially a common angular orientation by the cam follower bearing 70 during the translational retraction motion 64 independent of which cam groove is engaged by the cam follower bearing 70 at the commencement of the retraction motion.

More specifically, the drive shaft 60 may include a plurality of sets of integral cam grooves 72 with each set extending along the drive shaft surface from various positions around a corresponding portion of the periphery at the one end 74 to a corresponding common position 80 on the periphery at the other end 76 of the drive shaft 60. In the particular example depicted in FIG. 3, the drive shaft includes two sets 72 and 82 of integral cam grooves with each set covering a mutually exclusive portion of the periphery at the one end 74 of the drive shaft 60 and extending longitudinally therefrom along the surface of the drive shaft 60 to a corresponding common position 80 and 84, respectively, on the periphery at the other end 76. Preferably, the two sets each cover substantially a 180° portion of the periphery at the one end 74 of the drive shaft 60, in which case the common cam groove positions 76 and 84 on the periphery at the other end 76 of the drive shaft 60 may be disposed substantially 180° apart from each other.

The foregoing inventive principles described in connection with the sketch of FIG. 3 may be embodied in a radar antenna assembly similar to the one described in connection with FIGS. 1 and 2 to achieve the desired operation of rotating the antenna structure 10 in azimuth to a predetermined angular orientation automatically as it is being retracted from its deployed state to its stowed state against the surface of the supporting structure thereof.

Figure 4:
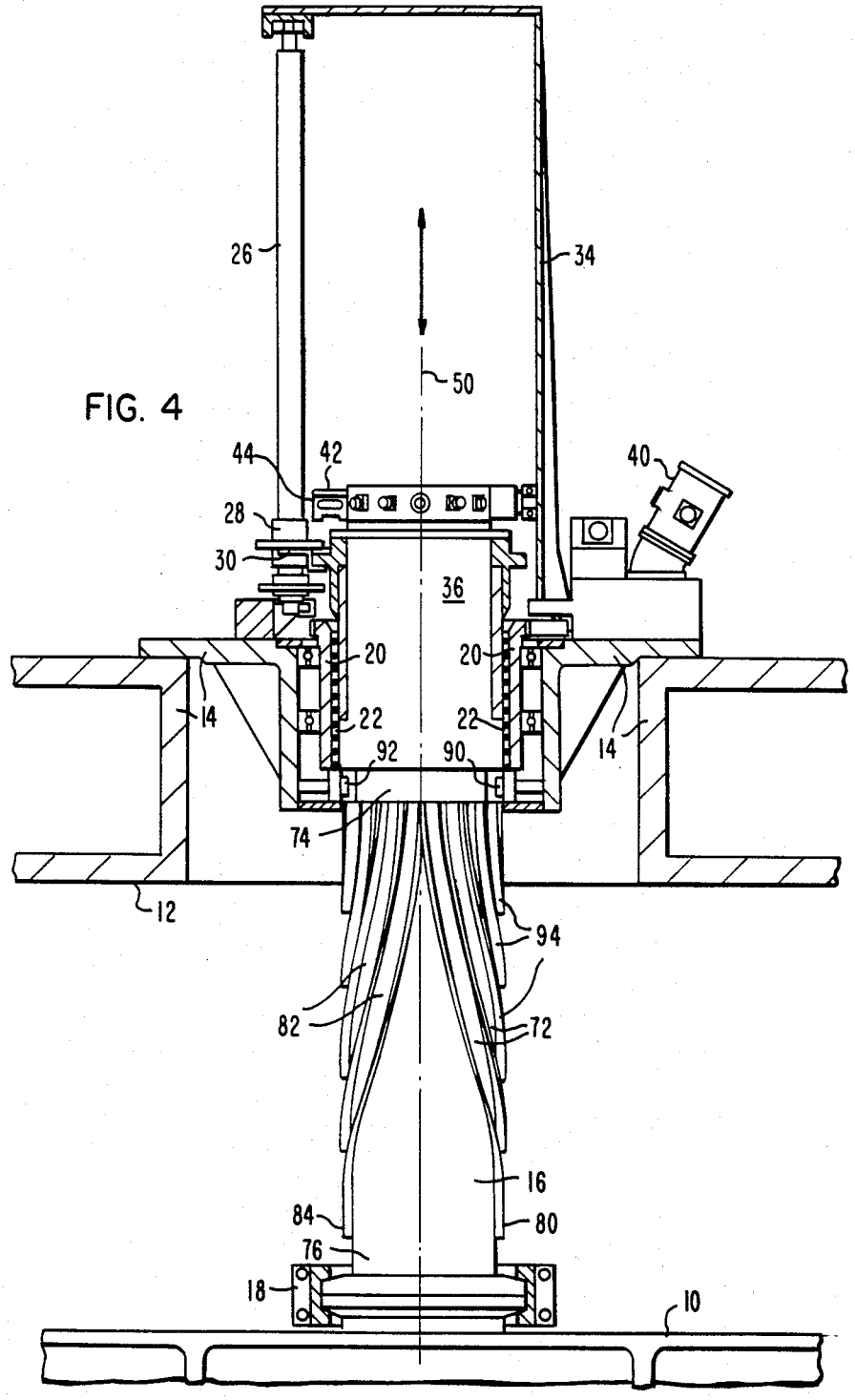
FIGS. 4 and 5 are cross-sectional illustrative views of a radar antenna assembly embodying the principles of the present invention in deployed and stowed states, respectively.
Figure 5:
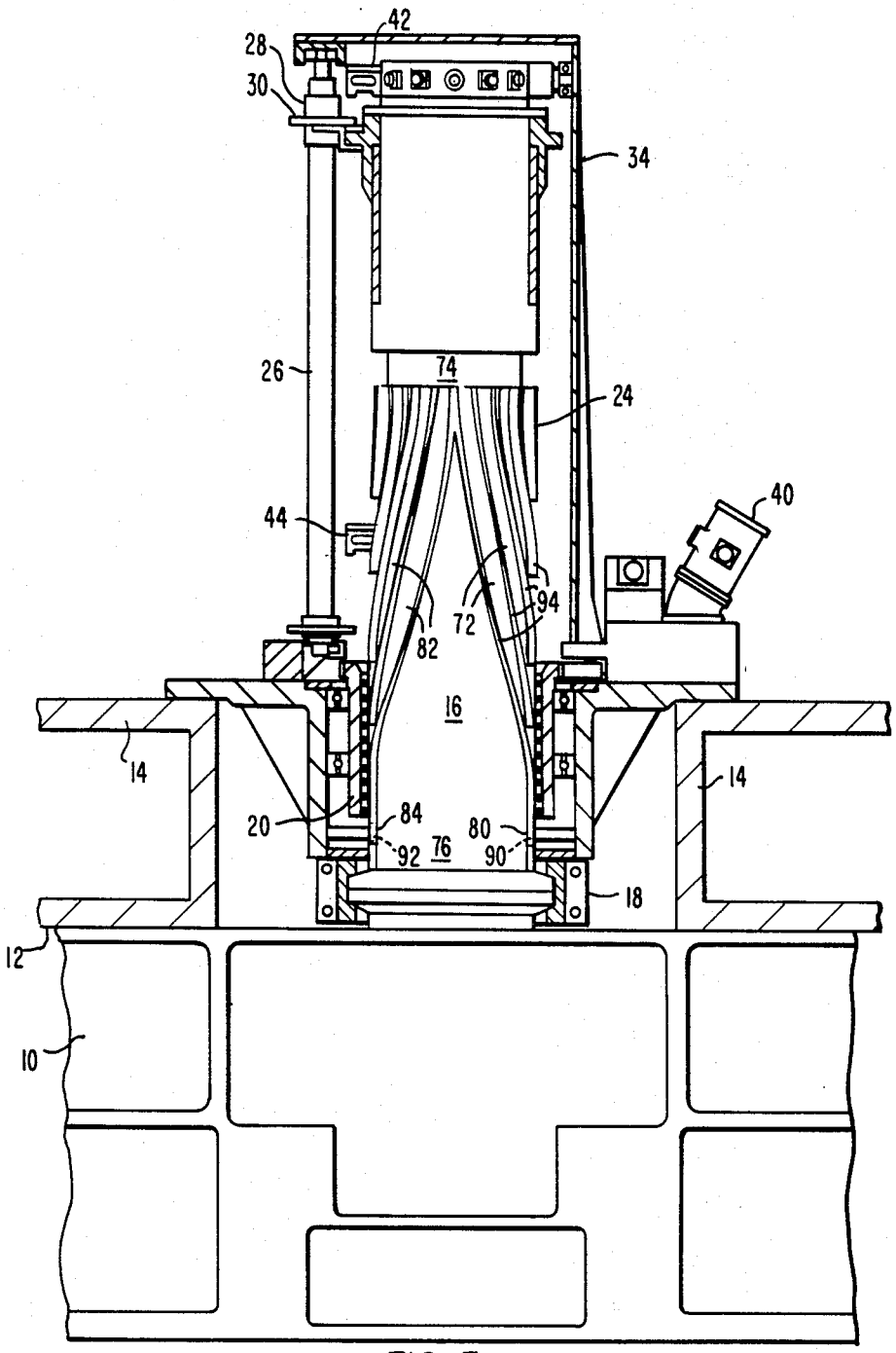

FIGS. 4 and 5 are cross-sectional illustrative views of a radar antenna assembly embodying the principles of the present invention in deployed and stowed states, respectively. In the embodiments of FIGS. 4 and 5, the main support structure 14 becomes the stationary housing with respect to which the drive shaft 16 moves translationally along the axis 50. The antenna structure 10 may be mechanically coupled to the end 76 of the drive shaft 16 and may move correspondingly in translation and rotation with the drive shaft 16. Thus, in the embodiment of FIGS. 4 and 5, the antenna assembly is supported by the stationary housing 14 which has a surface 12 and the antenna structure 10 is movable translationally along the axis 50 to render the antenna structure extended away from the stationary housing surface 12 in a deployed state (refer to FIG. 4) and retracted against the stationary housing surface 12 in a stowed state (refer to FIG. 5).

Accordingly, when in the deployed state as shown in FIG. 4, the antenna structure 10 is operative to rotate through an angular azimuth path about the axis 50 without contacting physically any surface protrusions of the stationary housing surface 12. Correspondingly, when in the stowed state, as shown in FIG. 5, the antenna structure 10 is disposed in a predetermined azimuth orientation to fit the contour of the surface 12 which it is designed to rest against in the stowed state.

In the embodiment of FIGS. 4 and 5, the drive shaft 16 includes two sets 72 and 82 of integral cam grooves with each set substantially covering a 180° portion of the periphery at the end 74 thereof. Each set of cam grooves 72 and 82 extend longitudinally from the end 74 along the surface of the shaft 16 to common positions 80 and 84, respectively, at the end 76. Two cam follower bearings 90 and 92 may be fixedly coupled to the stationary housing 14 and disposed in appropriate positions to engage randomly one of the cam grooves of their respective sets 72 and 82 at the commencement of the translational retraction movement of the shaft 16. As the shaft 16 is retracted translationally along the axis 50, the cam followers 90 and 92 cooperatively guide the drive shaft rotationally along the paths of their respective engaged cam grooves to substantially a common angular orientation during the translational retraction movement of the shaft 16 independent of the cam groove path taken. The common cam groove positions 80 and 84 correspond to the predetermined azimuth orientation of the antenna structure 10. Accordingly, the antenna structure 10 is driven to the predetermined azimuth orientation by the cam guided drive shaft rotation during retraction thereof.

In addition, the cam follower bearings 90 and 92 are further positioned on the stationary housing 44 to clear the longitudinal tips 94 of the cam grooves 72 and 82 along the periphery of the end 74 of the drive shaft 16 when the antenna structure is in the deployed state (refer to FIG. 4). Because of the provided clearance, the antenna structure 10 may be rotatably driven by the drive shaft 16 in the deployed state without the cam follower bearings 90 and 92 engaging any of the cam grooves 72 and 82 of the drive shaft 16.

In operation then the drive shaft 16 and antenna structure 10 may be extended to the deployed state as shown in FIG. 4 utilizing the hydraulic drive mechanism 40 in a conventional manner. Once in the deployed state, the antenna structure 10 is free to be rotated in azimuth about the axis 50 via drive shaft 16 and rotary joint assembly 36. Note that the cam follower bearings 90 and 92 clear the longitudinal tips 94 of the cam grooves 72 and 82 at the end 74 of the drive shaft 16. Under these conditions, the antenna structure 10 may be rotated in azimuth by the drive shaft 16 unimpeded by any contact between the cam follower bearings 90 and 92 and longitudinal tips 94.

Figure 1:
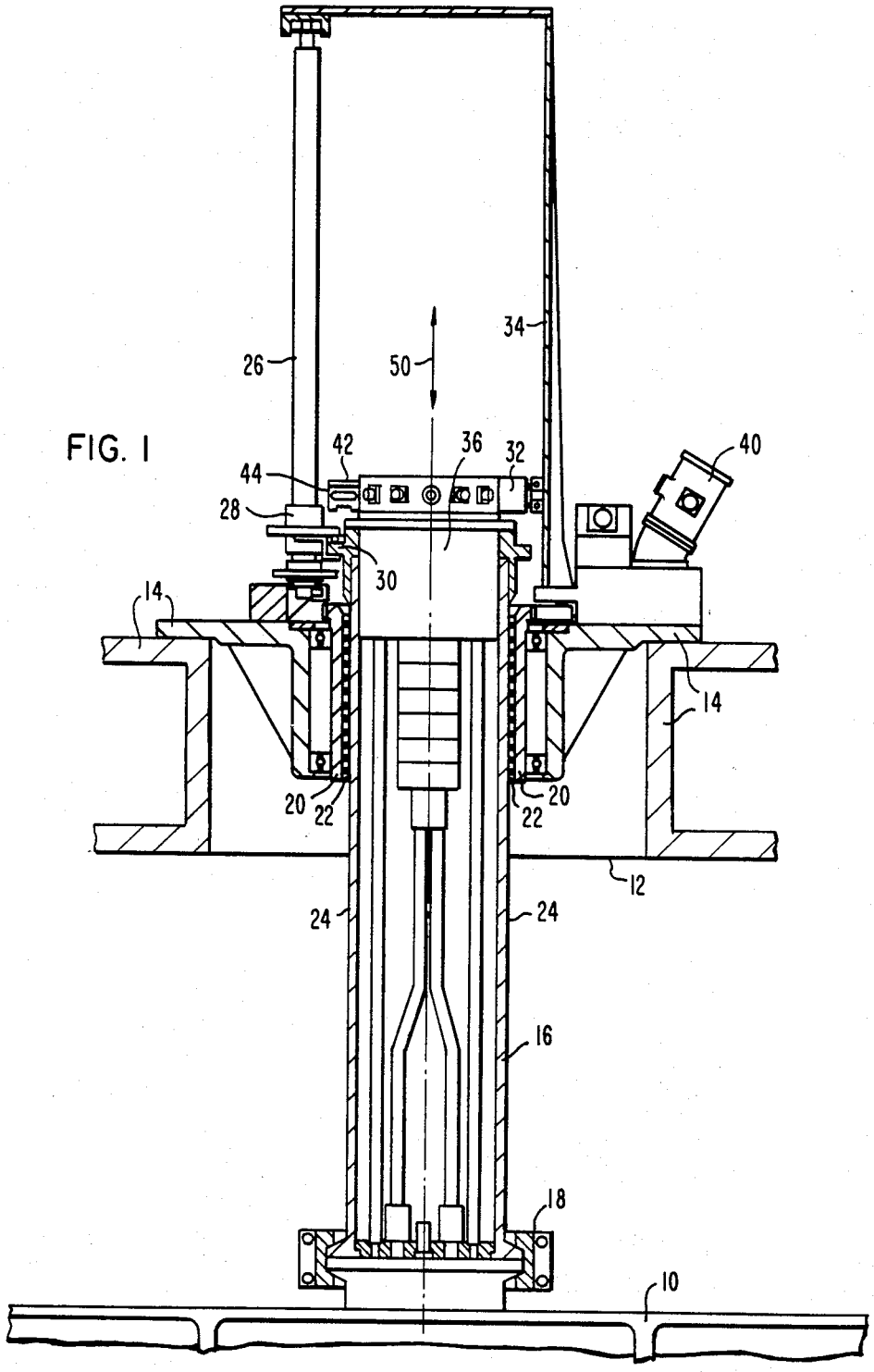
FIGS. 1 and 2 are cross-sectional illustrative views of an antenna assembly depicting the antenna structure thereof in a deployed and a stowed state, respectively.
Figure 2:
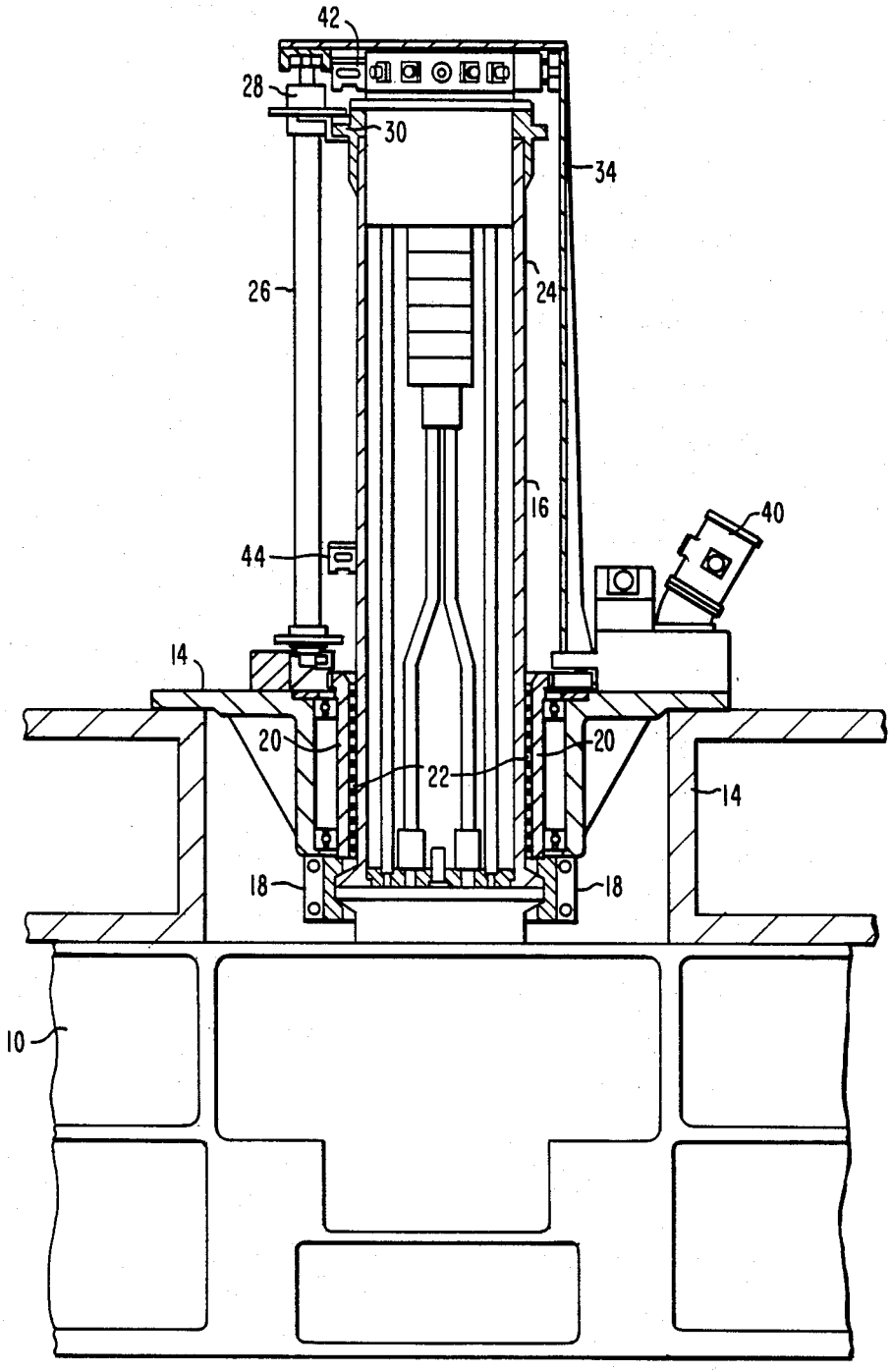

With the present antenna assembly as depicted by the embodiment of FIGS. 1 and 2, the antenna structure had to be first rotated to a predetermined azimuth orientation and then retracted translationally along the axis 50 to the stowed state. In contrast, the proposed antenna assembly in accordance with the present invention requires no such prior maneuvering of the antenna structure 10 before retraction thereof. Retraction may occur at any random azimuth orientation of the antenna structure. The cam follower bearings 90 and 92 may engage the cam groove 72 and 82, respectively, nearest to them around the periphery of the shaft 16 at the end 74. During the translational retraction movement, the cam follower bearings 90 and 92 may guide the drive shaft and associated antenna structure 10 rotationally along the engaged cam groove which terminates at the common angular positions 80 and 84 of the drive shaft 16 which correspond to the predetermined azimuth orientation of the antenna structure 10 (see FIG. 5). In this manner, the antenna structure 10 is rotated in azimuth to the predetermined angular orientation automatically as it is being retracted from its deployed state to its stowed state against the surface 12 of the supporting structure 14.

While a particular embodiment of the present invention has been described in connection with the cross-sectional illustrative views of FIGS. 4 and 5, it is understood that the principles of the present invention should not be so limited, but rather construed in breadth and broad scope in connection with the appended claims.

What is claimed is:

1. An antenna assembly supported by a stationary housing having a surface, said antenna assembly including an antenna structure translationally movable along a first axis to render said antenna structure extended away from said stationary housing surface in a deployed state and retracted toward said stationary housing surface in a stowed state, when in said deployed state, said antenna structure operative to rotate through an angular azimuth path about said first axis, when in said stowed state, said antenna structure disposed in a predetermined azimuth orientation, said antenna assembly including:

a drive shaft having mechanically coupled to one end thereof said antenna structure and translationally movable along said first axis to permit extension and retraction of said antenna structure with respect to said stationary housing surface, said drive shaft having a plurality of integral cam grooves disposed around the periphery at the other end thereof and extending longitudinally along the surface of said drive shaft to said one end thereof; and at least one cam follower bearing fixedly coupled to said stationary housing and disposed in a position to engage randomly one of said cam grooves of said plurality along the periphery at said other end of said drive shaft at the commencement of retraction of said antenna structure and to guide said drive shaft rotationally along the path of said engaged cam groove during said translational retraction movement of said antenna structure, said antenna structure being driven to said predetermined azimuth orientation by said cam guided drive shaft rotation during retraction thereof.

2. The antenna assembly in accordance with claim 1 wherein the cam follower bearing is further positioned on the stationary housing to clear the longitudinal tips of the cam grooves along the periphery of the other end of the drive shaft when the antenna structure is in the deployed state, whereby the antenna structure may be rotatably driven by the drive shaft in the deployed state without the cam follower bearing engaging any of the cam grooves of the drive shaft.

3. The antenna assembly in accordance with claim 1 wherein the integral cam grooves of the drive shaft extend from various positions around the periphery at the other end of the drive shaft to a common position on the periphery at the one end of the drive shaft to permit the drive shaft to be rotatably guided to substantially a common angular orientation by the cam follower bearing during the translational retraction movement of the drive shaft independent of which cam groove is engaged by the cam follower bearing at the commencement of retraction.

4. The antenna assembly in accordance with claim 3 wherein the common cam groove position on the periphery at the one end of the drive shaft corresponds to the predetermined azimuth orientation of said antenna structure.

5. The antenna assembly in accordance with claim 1 wherein the drive shaft includes a plurality of sets of integral cam grooves, each set extending along the drive shaft surface from various positions around a corresponding portion of the periphery at the other end of the drive shaft to a corresponding common position on the periphery at the one end of the drive shaft; and wherein the stationary support housing has fixedly coupled thereto a cam follower bearing for each set of integral cam grooves positioned to engage randomly one of the cam grooves of its corresponding set at the commencement of retraction and to cooperatively guide the drive shaft rotationally along the paths of their respective engaged cam grooves to substantially a common angular orientation during the translational retraction movement of the drive shaft.

6. The antenna assembly in accordance with claim 5 wherein the drive shaft includes two sets of integral cam grooves, each set covering a mutually exclusive portion of the periphery at the other end of the drive shaft and extending longitudinally therefrom along the surface of the drive shaft to a corresponding common position on the periphery at the one end of the drive shaft.

7. The antenna assembly in accordance with claim 5 wherein the drive shaft includes two sets of integral cam grooves, each set substantially covering a 180° portion of the periphery at the other end of the drive shaft and extending longitudinally therefrom along the surface of the drive shaft to a common position on the periphery at the one end of the drive shaft.

8. The antenna assembly in accordance with claim 7 wherein the common cam groove positions on the periphery at the one end of the drive shaft are disposed substantially 180° apart from each other.

* * * * *